US008727904B1

(12) United States Patent
La Vay et al.

(10) Patent No.: US 8,727,904 B1
(45) Date of Patent: May 20, 2014

(54) GOLF CLUB SHAFT GRIP

(75) Inventors: Richard Alan La Vay, Chester, MD (US); Mojgan Tehrani La Vay, Chester, MD (US); Bryce Glazier La Vay, Philadelphia, PA (US)

(73) Assignee: La Vay Sports Technologies, LLC, Chester, MD (US)

( * ) Notice: Subject to any disclaimer, the term of this patent is extended or adjusted under 35 U.S.C. 154(b) by 220 days.

(21) Appl. No.: 13/478,072

(22) Filed: May 22, 2012

Related U.S. Application Data

(63) Continuation-in-part of application No. 12/928,814, filed on Dec. 20, 2010, now abandoned.

(51) Int. Cl.
*A63B 53/14* (2006.01)

(52) U.S. Cl.
USPC ..... 473/301

(58) Field of Classification Search
CPC .... A63B 49/08; A63B 53/14; A63B 59/0014; A63B 59/0029; A63B 59/33
USPC ..... 473/300–303, 549–552, 568
See application file for complete search history.

(56) References Cited

U.S. PATENT DOCUMENTS

| | | | | |
|---|---|---|---|---|
| 1,556,781 | A | 10/1925 | Gjorup | |
| 2,000,295 | A * | 5/1935 | Oldham | 473/298 |
| 2,671,660 | A | 3/1954 | Goodwin | |
| 2,836,420 | A | 5/1958 | Lamkin et al. | |
| 3,087,729 | A * | 4/1963 | Sullivan | 473/301 |
| 4,174,109 | A | 11/1979 | Gaiser | |
| 4,552,713 | A | 11/1985 | Cavicchioli | |
| 5,216,069 | A | 6/1993 | Kobori | |
| 5,686,158 | A | 11/1997 | Gibbon | |
| 5,807,507 | A | 9/1998 | Hirano et al. | |
| 5,895,329 | A | 4/1999 | Huang | |
| 6,401,321 | B2 * | 6/2002 | Carey et al. | 29/450 |
| 6,558,270 | B2 * | 5/2003 | Kwitek | 473/301 |
| 6,971,959 | B1 | 12/2005 | Lu | |
| 2002/0052248 | A1 * | 5/2002 | Chen | 473/301 |
| 2002/0098904 | A1 * | 7/2002 | Huang | 473/300 |
| 2002/0142857 | A1 * | 10/2002 | Huang | 473/300 |
| 2002/0142858 | A1 * | 10/2002 | Chen | 473/301 |
| 2003/0045370 | A1 * | 3/2003 | Jaw | 473/302 |
| 2004/0259661 | A1 * | 12/2004 | Chen | 473/301 |
| 2008/0305883 | A1 | 12/2008 | Cameron | |

* cited by examiner

*Primary Examiner* — Stephen L. Blau
(74) *Attorney, Agent, or Firm* — Rahman LLC

(57) ABSTRACT

A golf club shaft grip and method include a coiled strip component adapted to be spirally wrapped under tension around a golf club shaft; a continuous groove joint formed along a spiral path adjacent the coiled strip component; an elongated bonding strip permanently seated into the continuous groove joint; and a prehensile tab operatively connected at an end of the elongated bonding strip. A single component golf club shaft grip and method include a coiled strip component adapted to be spirally wrapped under tension around a golf club shaft; and continuous groove joint integrally formed with the coiled strip component and positioned along a spiral path adjacent the coiled strip component, wherein the groove joint comprises a flange wall adjacent to only one of a top or bottom of the outer surface of the coiled strip, wherein the flange wall is formed along the spiral path adjacent the outer surface.

11 Claims, 6 Drawing Sheets

GOLF CLUB SHAFT GRIP

CROSS-REFERENCE TO RELATED APPLICATIONS

This application is a continuation-in-part of U.S. application Ser. No. 12/928,814 filed Dec. 20, 2010 and entitled "Golf Club Shaft Grip" the complete disclosure of which, in its entirety, is herein incorporated by reference.

BACKGROUND

1. Technical Field

The embodiments herein generally relate to sports equipment, and more particularly to golf club shaft grips.

2. Description of the Related Art

Installing and replacing golf club grips remains a time-consuming, cumbersome, tedious, and antiquated process. Most conventional golf club grips come in one of two forms. One type is an elongated flat strip of material which is helically wrapped around the golf club shaft with the ends of the strips secured by metallic fasteners, windings, glued or seated into plastic nipples, etc. The edges of the wrapped strip may be abutted, overlapped, interlocked or bound by wire or windings. Flat helically-wound elongated strips were the industry standard prior to the development of the other type of grip; the single-piece slip-on type tubular sleeve grip. However, a major problem common to helically wound strip type grips is the tendency of the side edges of the spiral to fray or curl from stretching, frictional contact with the golf bag and other clubs and exposure to perspiration, water, wind, and sun. Other problems include unraveling grips due to breakage of fasteners, windings, or deterioration of adhesives. Additionally, contrary to claims otherwise, a high level of skill is required to satisfactorily and consistently align the strip while wrapping. Even more problematic is the use of glues, tapes, and other adhesives to secure the elongated strip to the golf club shaft. Once the adhesive is applied it is difficult, if not impossible, to adjust the strip once the wrapping process has begun without weakening the essential bond between grip and golf club shaft from repeated readjustments. The difficulties attendant to helical strip type grips begged a solution: the conventional and ubiquitous single piece slip-on elastomer tubular sleeve was proposed.

Single piece slip-on elastomer sleeve type grips solved the curling edge problem. However, they generally made the process of installation more difficult by several magnitudes. Materials and tools typically required to replace and install a single piece slip-on elastomer sleeve include bench vice, shaft protector, solvent, sharp knife, double faced tape, rags, spray bottle, solvent recover tray, etc. Prior to installing a single piece slip-on elastomer tubular sleeve type grip, the installer must generally first remove the old grip, its underlying adhesive, then thoroughly clean the golf club shaft. The installer then applies new adhesive; most likely double faced peel-away tape to keep the sleeve grip in position once it is applied onto the club shaft. As the tape is sticky, the installer pours or spays a solvent over the tape, shaft, and inside surface of the sleeve grip to make them sufficiently slick to enable the installer to force the grip sleeve over the open end of the golf club shaft. The commitment of time and material coupled with the enhanced skill level required to satisfactorily complete the grip installation process is usually beyond the patience and skill level of the average golfer. Moreover, the freshly grip golf club must sit several hours to overnight before the adhesive dries sufficiently to permit use.

The conventional solutions generally do not provide a simple, quick, reliable, and comprehensive remedy to the problems attendant to spirally wrapped strips and single piece slip-on grips. Repeated attempts have been made to address the issues of time, skill, and material requirements of installing golf clubs grips including the need of adhesives, fasteners, or windings to secure the grip to golf club shaft. The U.S. Patents and Publications cited below describe various technologies that have advanced golf equipment manufacturing, and while each reference was useful at the time they were created and for the specific purpose for which they were intended, the golf industry has evolved so quickly that many of these useful techniques are no longer readily applicable for today's modern golf industry and game. The current inventors are not denigrating the cited references, but are merely identifying observations with respect to the corresponding technologies and their uses in today's practical applications.

For example, U.S. Pat. No. 2,671,660 issued to Goodwin, the complete disclosure of which, in its entirety is herein incorporated by reference, discloses a flat and substantially planar resilient flanged strip attached to an integral cap. The cap is positioned over an open end of the club and the strip is stretched and wrapped around golf club shaft utilizing the strip's frictional properties against the club shaft to avoid the need for adhesives to keep the grip in place. The abutting and overlapping flanged edges are used as a guide to assist the installer during wrapping. An additional winding/wire may be wrapped around the strip to apply additional pressure to the golf club shaft.

Goodwin generally proposes a remedy for grip/shaft adhesive failures and a simplification of the task of wrapping and aligning the strip around the golf club shaft. However, the dimensional properties and sole reliance on frictional characteristics of the material may not adequately work with current state of the art golf club shafts. For example, as the strip is stretched and wrapped, the outer and inner surfaces of the strip begin experiencing disparate shear forces resulting in cracking and failure of the top surface of the strip. Additionally, the stretched outer surfaces and edges of the strip tend to plasticize resulting in concaving of the top surface, curling of edges, loss of tensile strength and thereby loss of the wrap's "grip" on the golf club shaft. Furthermore, the winding generally fails to offset the above described forces.

U.S. Pat. No. 2,836,420 issued to Lamkin, the complete disclosure of which, in its entirety is herein incorporated by reference, discloses a locking mechanism stitching together two strips with preformed resilient curls. The stitched strips are spirally wrapped around the shaft with resilient curls overlapping, and attempt to inhibit the curling of the edges. The Lamkin patent uses leather material to attempt to resist curling. However, in the many years since the Lamkin's patent was issued, the use of leather has proven to be an infective material for this purpose due to material stretching caused by use. Additionally, the Lamkin patent does not describe how the strip is secured to the golf club shaft. Furthermore, the abutting edge joint in the Lamkin patent is not water tight in practice. Finally, the skill level required to wrap Lamkin's strip is generally high.

U.S. Pat. No. 1,556,781 issued to Gjorup, the complete disclosure of which, in its entirety is herein incorporated by reference, attempted to improve upon strip type grips by using a stretched elastic tape held in place by the frictional properties of the elastic, and optionally reinforced by adhesive applied to the underside of the tape. However, exclusive reliance on the frictional properties of the elastic material to secure the strip to shaft has proven to be less than desirable. Additionally, the optional adhesive described in the Gjorup patent generally does not overcome the tensile forces of the stressed strip grip, especially in modern day golf shafts.

U.S. Pat. No. 4,174,109 issued to Gaiser, the complete disclosure of which, in its entirety is herein incorporated by reference, discloses a flat strip with one open edge the other edge containing adhesive tape. The tape is spirally wrapped around the handle with the tape covering the seam. Additionally, no adhesive is used to secure the tape to the handle.

U.S. Pat. No. 5,895,329 issued to Huang, the complete disclosure of which, in its entirety is herein incorporated by reference, discloses a cap and elongated strip with reinforced recessed side edges and peel-away tape attached to the underside of the strip. The strip is spirally wrapped around the golf club shaft with peel-away adhesive securing the strip to the shaft. The strip is further secured at the bottom with finishing tape and the top by affixing a cap. The issue of adhesive is not addressed in the Huang patent; only the ease of installation and curling of side edges of the strip. The Huang patent further addresses the issue of ease of installation touting the general nature of the spirally wrapped type of grip. The Huang patent further describes compressing the edges with a heated platen to inhibit the curling of the strip edges, and suggests that adhesive may be applied while wrapping to help bond the abutting edges.

In practice, the device provided in the Huang patent does not generally factor in the impact that the natural expansion and contraction from use and exposure to climate has on the compressed edges of the strip, which may lead to curling or fraying of the strip in practice. The adhesive on the underside of the strip tends to limit re-adjustments during wrapping and, in practice, tends to undermine the objective of ease of installation, notwithstanding the difficulty of applying adhesive to abutting edges while wrapping. In later patents Huang resorted to wrapping the strip around an underlisting sleeve first then applying as a unitary slip-on.

U.S. Pat. No. 6,971,959 issued to Lu, the complete disclosure of which, in its entirety is herein incorporated by reference, discloses a locking mechanism that inhibits the curling of the edge by locking the upper and lower edges. However, both the Gaiser and Lu patents do not generally address the issue of securing a strip to a handle suggesting adhesive is applied to the shaft. The Lu patent bonds the edges of the interlocking edges with adhesive, but unfortunately there is no teaching of how to insure a snug fit of the wrap upon initial installation.

The concept of replacing adhesive with tensile stressed elastic has been used in the past. A viable wrap style alternative to the unitary sleeve type grip to avoid the need for adhesive to secure the grip to the shaft must generally: first, provide a simple and user-friendly method of quickly wrapping strip around shaft; second, stabilize the tensile forces allowing them to continue their adhesive work without risk of unraveling and plasticization of material; and third, the ability to quickly remove the grip without the mess of slip-ons. To date, no solution provides a grip addressing all three of the above. A wrap style grip offers the best hope for convenience and ease of installation. However, in order to be commercially viable, the wrap around must equal the slip-on in quality and durability without the fear of shear failure, edge fraying, etc. In the mistaken belief that edge fraying was the paramount issue in the early pursuit of an improved golf club grip, which had been resolved through single piece, most advances in golf grips have been confined to materials only. The issue of convenience has been generally ignored.

Wrap style to a limited extent, and slip-ons nearly exclusively have been made of one form or another of vulcanized rubber. Since the 1930s the properties of silicone rubber has attracted golf grip manufactures. Silicone is durable, resists hardening or cracking, water resistant, flexible, soft shock absorbent, and can be produced in a wide range of colors unlike carbon-based vulcanized rubber, which are all qualities advantageous to golf club grips. Under extreme temperature, the silicone rubber's tensile strength, elongation, and tear resistance is superior to most conventional rubber materials. However, wet silicone can be slippery and has a higher specific gravity (heavier) than traditional single piece slip-on tubular sleeve type grips.

U.S. Pat. No. 4,552,713 issued to Cavicchioli, the complete disclosure of which, in its entirety is herein incorporated by reference, addressed the slippery nature of silicone in handgrips through a process of buffering the surface of the cured product and adding texturizing material. U.S. Pat. No. 5,686,158 issued to Gibbon, the complete disclosure of which, in its entirety is herein incorporated by reference, addressed the specific gravity (weight) issue by adding various material fillers in attempt to add strength while reducing weight. U.S. Patent Application Publication No. 2008/0305883 published to Cameron, the complete disclosure of which, in its entirety is herein incorporated by reference, discloses a silicone rubber grip. U.S. Pat. No. 5,216,069 issued to Kobori and U.S. Pat. No. 5,807,507 issued to Hirano, the complete disclosures of which, in their entireties are herein incorporated by reference, describe silicone elastomers having trace elements of boron.

SUMMARY

In view of the foregoing, an embodiment herein provides a golf club shaft grip comprising a coiled strip component adapted to be spirally wrapped under tension around a golf club shaft; a continuous groove joint formed along a spiral path adjacent the coiled strip component; an elongated bonding strip permanently seated into the continuous groove joint; and a prehensile tab operatively connected at an end of the elongated bonding strip. The golf shaft grip may further comprise a cap positioned at a top portion of the coiled strip component; and a tab positioned at a bottom end of the coiled strip component. The cap may comprise an integral structure with the coiled strip component. Any of the coiled strip component, the cap, and the elongated bonding strip may comprise elastic material. The elastic material may comprise self-fusing silicone. The coiled strip component may be adapted to be secured to the golf club shaft using any of peel-away adhesive and self-fusing silicone by wrapping the tab around the golf club shaft. The coiled strip component may comprise an outer surface and an inner surface, wherein the groove joint may comprise groove walls adjacent to each of a top and bottom of the outer surface, wherein the groove walls may be formed along the spiral path adjacent the outer surface, and wherein the groove joint may comprise a groove edge adjacent to each of the groove walls and the inner surface. The elongated bonding strip may comprise contact surfaces, and the elongated bonding strip may be seated into the continuous groove joint causing a permanent bond between the groove walls and the contact surfaces. The golf shaft grip may further comprise peel-away adhesive in between the groove walls and the contact surfaces. The outer surface may comprise a plurality of alignment marks adapted to be aligned with one another. The elongated bonding strip may comprise a reinforcing mesh material configured therein.

Accordingly, the embodiments herein provide a two-component golf club shaft grip and means for installing onto and removing from a golf club shaft. The first component comprises a helical resilient coil with an integral cap and side edges, and is spirally wrapped under tension around a golf club shaft with the side edges firmly abutting and forming a continuous groove joint. The helical resilient coil with an integral cap may be comprised of a single or a plurality of elastic material including, in whole or in part of, self-fusing silicone. The helical resilient coil with an integral cap may be secured to a golf club shaft with peel-away adhesive or self-fusing silicone by wrapping the terminal end tab around the shaft, forming a completed resilient coil assembly. The second component includes an elongated bonding strip with multiple possible cross sections comprised of one or a plurality of materials including self-fusing silicone and is permanently seated into a continuous groove joint of resilient coil assembly forming an improved unitary golf club shaft grip. Methods of permanently joining an elongated bonding strip and resilient coil assembly forming an improved unitary golf club shaft grip may include, where components comprise, in whole or in part, of self-fusing silicone, applying pressure to the elongated bonding strip as it is seated into continuous groove joint effecting a permanent bond between groove walls of the resilient coil assembly and contact walls of an elongated bonding strip. Another method of permanently joining components may include utilization of peel-away adhesive previously fastened to the contact walls of the elongated bonding strip as an adhesive to permanently join contact surfaces of the elongated bonding strip and continuous groove joint of the resilient coil assembly. To remove golf club shaft grips from the shaft, a prehensile quick-release tab located at the end of the elongated bonding strip is grasped forcibly unwinding the elongated bonding strip, separating the elongated bonding strip from the resilient coil assembly. The integral cap is located at the top of the resilient coil assembly and can be removed from the top of the golf club shaft. The golf club shaft is now ready for installation of a new golf club shaft grip.

Another embodiment provides a single component golf club shaft grip comprises a coiled strip component adapted to be spirally wrapped under tension around a golf club shaft; and a continuous groove joint integrally formed with the coiled strip component and positioned along a spiral path adjacent the coiled strip component, wherein the coiled strip component comprises an outer surface and an inner surface, wherein the groove joint comprises a flange wall adjacent to only one of a top or bottom of the outer surface, wherein the flange wall is formed along the spiral path adjacent the outer surface, and wherein the groove joint comprises a groove edge adjacent to the flange wall and the inner surface. The golf shaft grip may further comprise a cap positioned at a top portion of the coiled strip component; and a tab positioned at a bottom end of the coiled strip component. The cap may comprise an integral structure with the coiled strip component. Any of the coiled strip component and the cap may comprise elastic material. The elastic material may comprise self-fusing silicone. The coiled strip component may be adapted to be secured to the golf club shaft using any of peel-away adhesive and self-fusing silicone by wrapping the coiled strip component around the golf club shaft. The flange wall may be adapted to be spirally wrapped around the golf club shaft, wherein an undersurface of a top edge of the flange wall lies congruous with a reciprocal outer surface of a bottom edge of the flange wall. The outer surface may comprise a plurality of alignment marks adapted to be aligned with one another.

Accordingly, a single component golf club shaft grip and means for installing onto a golf club shaft is provided. The single component is comprised of a flanged resilient coil with an integral cap that is spirally wrapped under tension around a golf club shaft. The flanged resilient coil with an integral cap may comprise, in whole or in part, of self-fusing silicone. The flange is spirally wrapped such that the undersurface of the top edge of the flange lies congruous with the reciprocal outer surface of the bottom edge of the flange forming an improved unitary golf club shaft grip. Methods of permanently joining the undersurface and outer surface of the flange may include adhesives, including peel-away tape and when the component is made in whole or in part of self-fusing silicone, applying pressure to the outer surface of the top edge flange as it is wrapped around golf club shaft.

Another embodiment provides a method comprising providing a golf club shaft; positioning a cap on top of the golf club shaft; tensionally wrapping a coiled strip component operatively connected to the cap and spirally along and around the golf club shaft; aligning the coiled strip component around the golf club shaft to form a continuous groove joint along a spiral path adjacent the coiled strip component; permanently seating an elongated bonding strip into the continuous groove joint; and creating a prehensile tab operatively connected at an end of the elongated bonding strip.

Another embodiment provides a method comprising providing a golf club shaft; positioning a cap on top of the golf club shaft; tensionally wrapping a coiled strip component operatively connected to the cap and spirally along and around the golf club shaft, wherein the coiled strip component comprises an outer surface and an inner surface; and aligning the coiled strip component around the golf club shaft to form a continuous groove joint integrally formed with the coiled strip component and positioned along a spiral path adjacent the coiled strip component, wherein the groove joint comprises a flange wall adjacent to only one of a top or bottom of the outer surface, wherein the flange wall is formed along the spiral path adjacent the outer surface, and wherein the groove joint comprises a groove edge adjacent to the flange wall and the inner surface.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1:
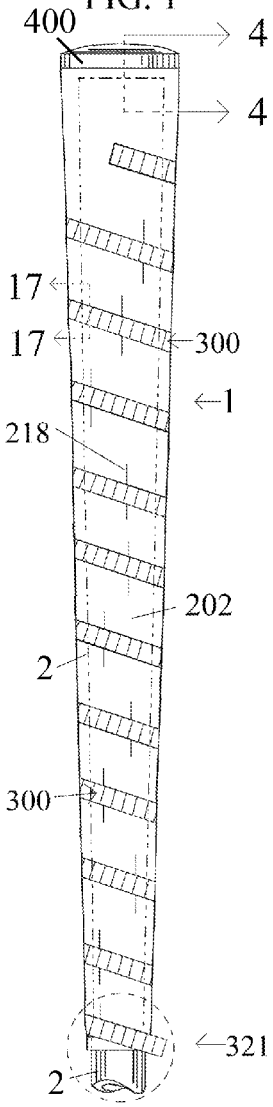
FIG. 1 is a front elevation view of a golf club shaft grip installed onto a golf club shaft according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a golf club shaft grip that overcomes the limitations of the conventional grips. The golf club shaft grip in accordance with the embodiments herein provide a golf player with an improved golf club grip that can be quickly removed and installed by someone unskilled in the art and otherwise unwilling to expend the time or suffer the inconvenience of removing and installing contemporary and conventional unitary elastic tubular sleeve type golf club grips. Referring now to the drawings, and more particularly to FIGS. 1 through 23, where similar reference characters denote corresponding features consistently throughout the figures, there are shown preferred embodiments.

FIGS. 1 through 23 represent various views of a golf club shaft grip 1 according to an embodiment herein. The grip 1 includes a helical resilient coil 200 with an integral cap 400, and an elongated bonding strip 300; various views of which are further illustrated in FIGS. 10 through 14. The integral cap 400 is positioned over the top of a golf club shaft 2. FIG. 6 shows integral cap 400 positioned over an open golf club shaft 2 with the helical resilient coil 200 and integral cap 400 partially wound. The helical resilient coil 200 with the integral cap 400 is shown in FIG. 3 to be tightly wrapped around golf club shaft 2 with side edges 215 snugly abutting and alignment mark 218 aligned forming a continuous groove joint 3 as further shown in FIG. 7, and creating a resilient coil assembly 8 as depicted in FIG. 8. In FIG. 3 peel-away tape 36 located on the inside surface 204 of the terminal end tab 212 keeps terminal end tab 212 temporarily affixed to golf club shaft 2 and resilient coil assembly 8 (of FIG. 8) from unraveling. The elongated bonding strip 300 is manually seated into continuous groove joint 3 of resilient coil assembly 8 beginning at the mouth 251 (shown in FIGS. 3, 6, 8, 9 and 15) that runs the helical length of resilient coil assembly 8. Peel-away adhesive 211 is attached to contact surface 585 (further shown in FIGS. 10 through 14) of elongated bonding strip 300 bond the groove wall 214 of the continuous groove joint 3 with the contact surface 585 of elongated bonding strip 300. A prehensile quick-release tab 321 (further shown in FIGS. 1 through 3) can be seen slightly protruding beyond terminal end tab 212.

To remove the golf club shaft grip 1 from the golf club shaft 2 the elongated bonding strip 300 (of FIGS. 10 through 14) is separated from the contiguous groove joint 3 (of FIG. 7) by grasping the prehensile quick-release tab 321 with a hand or tool and forcibly stripping the elongate bonding strip 300 from the continuous groove joint 3. The golf club grip 1 depicted in FIG. 1, its components parts; namely helical resilient coil 200 with integral cap 400 and elongated bonding strip 300, and its embodiments, may be manufactured through a single or multiple of processes including, but not limited to, injection molding, liquid injection molding, compression molding, transfer molding or sectioning of a unitary elastic tubular sleeve 23 (see FIG. 23) and may be comprised of variety of natural or composite of a single or plurality of natural or composite materials, or in accordance with one embodiment made in whole or in part of self-fusing silicone 172 (see FIG. 19).

The self-fusing silicone 172 is used as an alternative to conventional tapes used for a variety of purposes including as an add-on for existing tool handles and sports grips. Unfortunately, wrapping self-fusing tape around existing golf club grips to add texture or durability to the underlying grip or golf club shaft has several problems, which the embodiments herein overcome by not using self-fusing tape, but rather by having self-fusing silicon 172 being incorporated into the material of the helical resilient coil 200, cap 200, and/or elongated bonding strip 300.

Unlike most tool or sports equipment handles it is important that a golf club grip (e.g., golf club grip 1) is consistent in surface without any irregularities, imperfections, bumps, etc. upon manufacture and installation such that each grip should be virtually identical. However, the physical properties inherent to pliable self-fusing tape make consistent repeated application of tape problematic for use in golf club shaft grip uses. Furthermore, traditional self-fusing silicone tape comes in a variety of thicknesses ranging from 1 mm upwards. However, the United States Golf Association (USGA) rules with respect to golf club grips states that "the maximum and minimum diameters of the cross-section at any point [of the club grip] must not differ by more than 0.04 inches (1 mm)." The other dominant governing golf body, the Royal and Ancient (R and A) states that "the grip must be circular in cross-section, except that a continuous, straight, slightly raised rib may be incorporated along the full length of the grip." By applying traditional self-fusing tape to an existing grip, the self-fusing tape must overlap (touch) to fuse thereby insuring its cross-section will never meet the round standard of the R and A.

Furthermore, although the minimum thickness of self-fusing silicone on the market is 1 mm, golfers still can never be certain the application (overlap) conforms with the governing body limitation; making the use of self-fusing tape ineffectual as an "add-on" wrap for existing club grips. Moreover, in the unlikely event that an individual extraordinarily skilled in the art of golf club shaft grip wrapping were to apply the tape such as to conform with rules, the 1 mm thickness of the tape would not withstand the rigors of repeated contact with the edges of the golf bag and other clubs as the club is inserted or withdrawn. Increasing the thickness of the tape in an attempt to strengthen would only exacerbate the problems described above.

Fashioning a new golf club grip by wrapping tape around a bare golf club shaft while conforming to golf industry standards and rule making specifications increases the level of skill incalculably. The application or introduction of self-fusing silicone tape in the manufacture or improvement of existing golf club grips fails to resolve the issues and limitations of the technology described above. Regardless of its elastomer and its adhesive properties self-fusing silicone tape is suitable only as an add-on to selected sports handles such as a tennis racket or hockey stick but unsuitable as a substitute or alternative in the manufacture of industry standard golf club grips. Notwithstanding the inherent problems of self-fusing silicone tape described above, self-fusing silicone rubber incorporated as a source material in whole or in part in the manufacture of selected conventional designs may overcome many of the shortcomings attendant to spirally wound applications specifically with respect to edge fraying and adhesive degradation that resulted in the failure of many spirally wound grip applications in accordance with the embodiments herein. However, with respect to its application in new golf club grips no teaching, until the embodiments herein, has utilized or incorporated self-fusing silicone 172 into the golf club grip 1, in whole or in part, for its self-fusing properties including for injection molding manufacturing.

Figure 2:
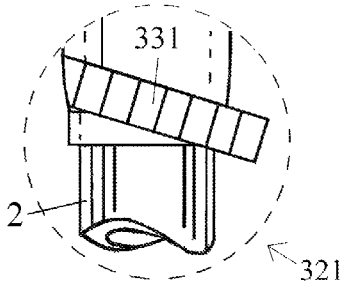
FIG. 2 is an enlarged detail view of the encircled area designated in FIG. 1 detailing a prehensile quick-release tab according to an embodiment herein.
Figure 3:
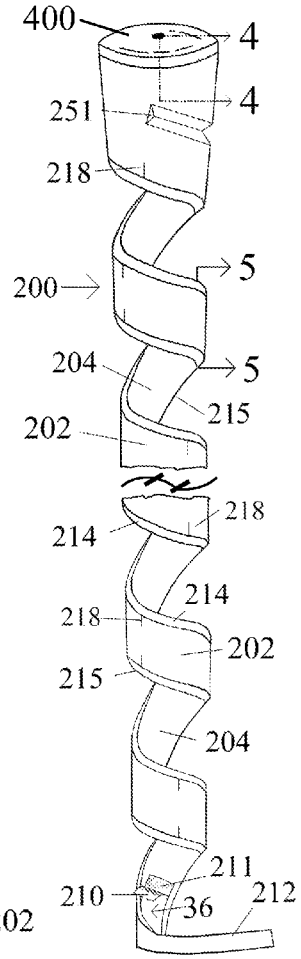
FIG. 3 is a front perspective view of a helical resilient coil with an integral cap according to an embodiment herein.
Figure 4:
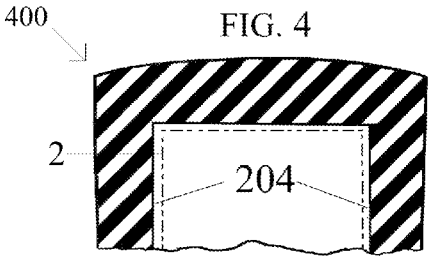
FIG. 4 is an enlarged sectional view of an integral cap taken along the section lines 4-4 in FIGS. 1 and 3 according to an embodiment herein.

FIG. 2 is an enlarged detail of the encircled area designated in FIG. 1 displaying a prehensile quick release tab 321. FIG. 3 shows the helical resilient coil 200 with integral cap 400 embodying the embodiments herein. Constituent components of resilient helical coil 200 with integral cap 400 include side edges 215, inside surface 204, groove wall 214, mouth 251, alignment mark 218, and terminal end tab 212. The helical resilient coil 200 with integral cap 400 tapers at the end forming terminal end tab 212. The alignment mark 218 can be painted or notched onto the outside surface 202 of helical resilient coil 200 during or after fabrication. In the interest of clearly illustrating its constituent elements, the helical resilient coil 200 is shown as if suspended from integral cap 400 in FIG. 4 influenced by gravity and slightly unwound. FIG. 4 shows a sectional view of integral cap 400 located at the top or helical resilient coil 200 taken along section lines designated 4-4 in FIGS. 1 and 3 positioned over the top/open end of the golf club shaft 2.

Figure 5:
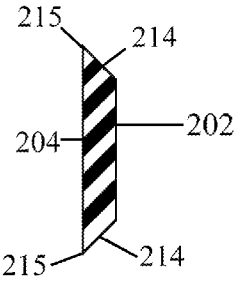
FIG. 5 is an enlarged sectional view taken along the section lines 5-5 in FIGS. 3 and 8 according to an embodiment herein.
Figure 6:
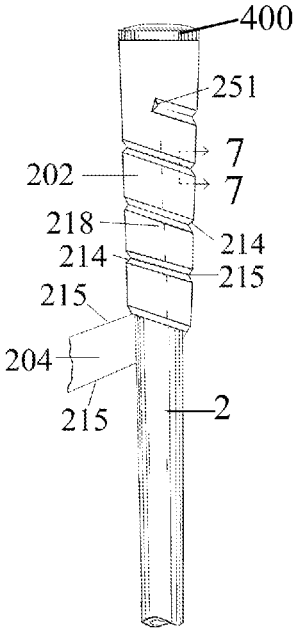
FIG. 6 is front broken elevation view of a helical resilient coil with integral cap in the process of being spirally wrapped around a golf club shaft after an integral cap has been positioned over open end of golf club shaft according to an embodiment herein.
Figure 16:
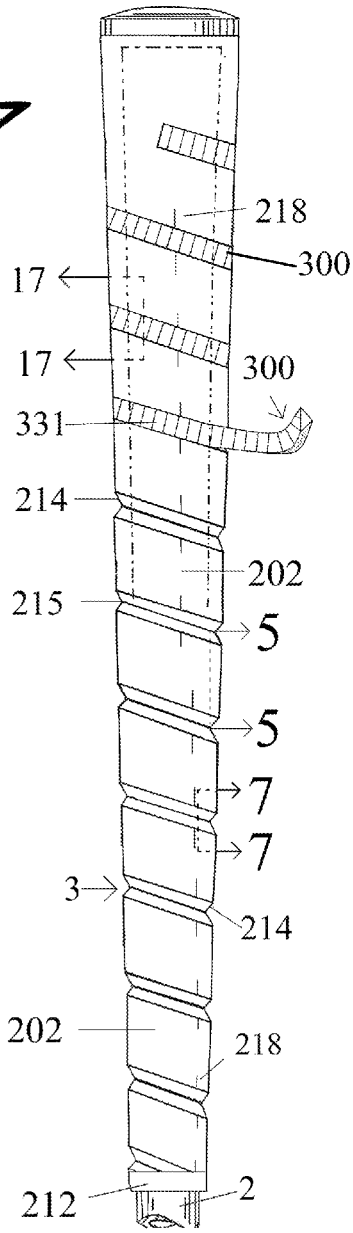
FIG. 16 is a front elevation of an elongated bonding strip partially seated into the continuous groove joint of a resilient coil assembly according to an embodiment herein.

FIG. 5 is an enlarged cross section of the lines designated 5-5 in FIGS. 3, 8, and 16 displaying side edges 215, groove wall 214, outside surface 202, and inside surface 204. FIG. 6 displays the helical resilient coil 200 with integral cap 400 in the process of being wrapped around golf club shaft 2 after integral cap 400 has been successfully positioned over the top/open end of golf club shaft 2 embodying the embodiments herein. The side edges 215 properly abut and alignment mark 218 are properly aligned. FIG. 6 also displays the physical relationship between side edges 215 and groove wall 214 as depicted in further detail in FIG. 7.

Figure 7:
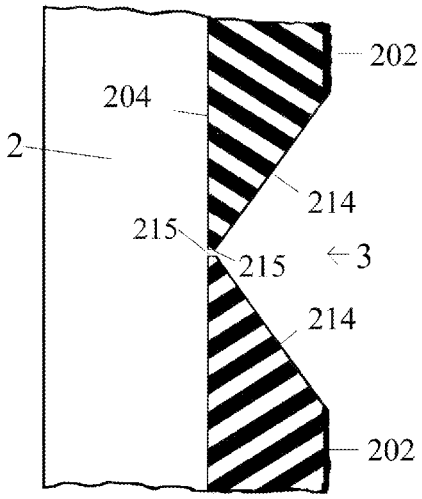
FIG. 7 is an enlarged sectional view of a continuous groove joint taken along section lines designated 7-7 in FIGS. 6, 8, 15, and 16 according to an embodiment herein.
Figure 8:
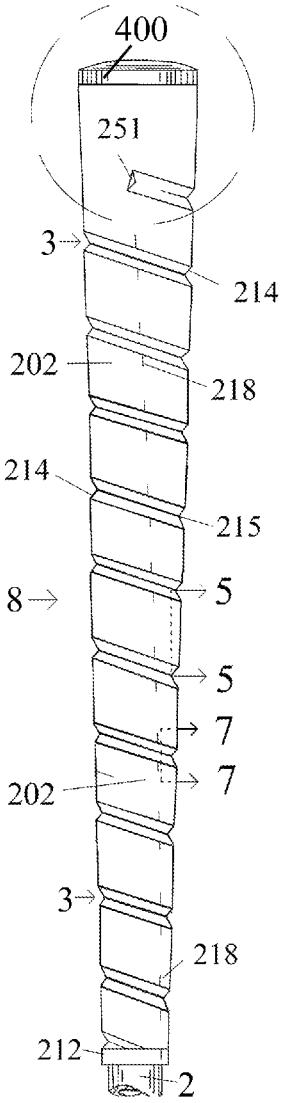
FIG. 8 is a front elevation view of a wrapped helical resilient coil with an integral cap in completed form designated as a resilient coil assembly according to an embodiment herein.

FIG. 7 is an enlarged sectional view of a continuous groove joint 3 formed by snugly abutting side edges 215 during the wrapping of helical resilient coil 200 with integral cap 400 around golf club shaft 2 taken along the sectioned lines designated 7-7 in FIGS. 6, 8, 15, and 16 embodying the embodiments herein. The points at which the side edges 215 abut forming the continuous groove joint 3 are visible in FIG. 7 as well as groove wall 214 and illustrated in enlarged detail in FIG. 17A. Although the continuous groove joint 3 in FIG. 7 appears configured as a horizontal "V" the continuous groove joint 3 can take multiple shapes and forms as dictated by the cross section or dimensional properties of the corresponding reciprocal mating point along elongated bonding strip 300 as illustrated in further detail in FIGS. 17, 17B, and 19, and the embodiments herein are not limited to a particular geometric configuration.

FIG. 8 illustrates a resilient coil assembly 8 embodying the embodiments herein. In this case, peel-away tape cover 210 from the inside surface 204 of terminal end tab 212 (seen at bottom of FIG. 3) has been removed adhesively affixing the inside surface 204 of terminal end tab 212 to golf club shaft 2, temporarily preventing resilient coil assembly 8 from unraveling. The continuous groove joint 3 begins with the mouth 251 continuing helically around ending at terminal end tab 212.

Figure 9:
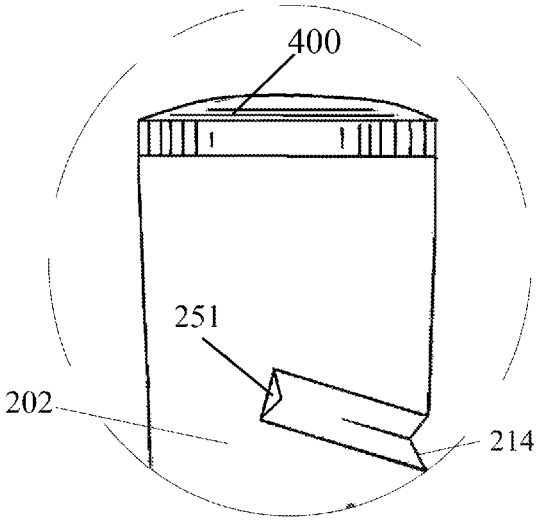
FIG. 9 is an enlarged detail view of the encircled area designated in FIG. 8 according to an embodiment herein.

FIG. 9 is an enlarged view of the designated encircled area in FIG. 8 detailing mouth 251 of resilient coil assembly 8. The mouth 251 is made during the fabrication of helical resilient coil 200 with integral cap 400 by various methods including sectioning a unitary elastic tubular sleeve 23 or fabrication in preformed mold. The dimensional characteristics of the mouth 251, its constituent elements: groove wall 214 and side edges 215 are interdependent with dimensional characteristics of insertion tab 380, its constituent elements: insertion tab surface 510 and contact surface 585, such that they are fabricated as congruent dependent mates embodying the embodiments herein.

Figure 10:
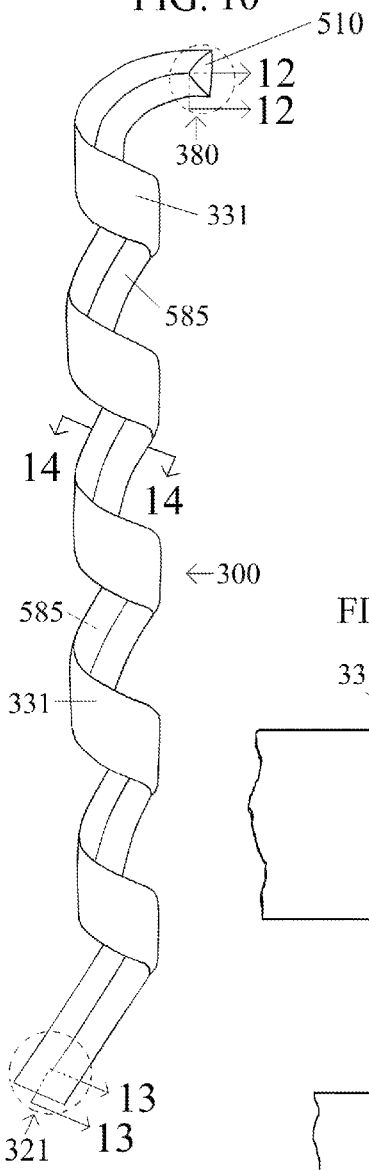
FIG. 10 is a front elevation view of an elongated bonding strip according to an embodiment herein.
Figure 11:
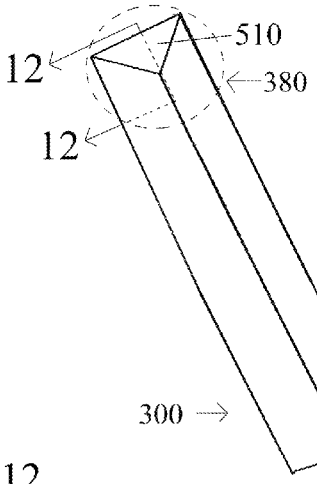
FIG. 11 is a bottom perspective view of an elongated bonding strip according to an embodiment herein.
Figure 11A:
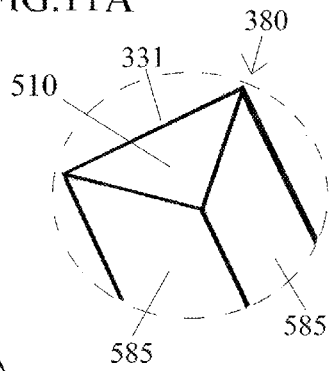
FIG. 11A is an enlarged bottom view of the encircled area designated in FIG. 11 detailing an insertion tab according to an embodiment herein.
Figure 12:
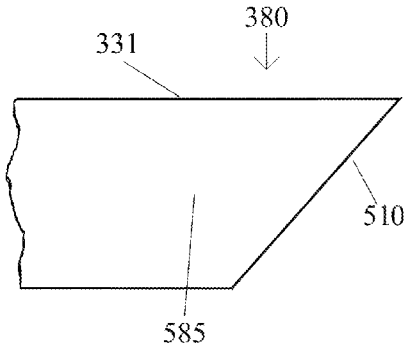
FIG. 12 is an enlarged broken side sectional view of an insertion tab taken along the section lines designated 12-12 in FIGS. 11 and 18 according to an embodiment herein.
Figure 12:
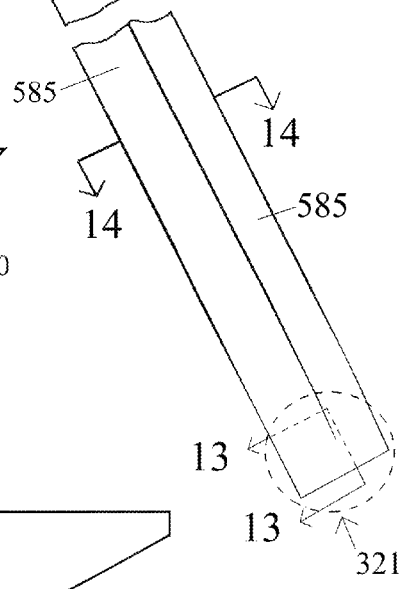
Figure 13:
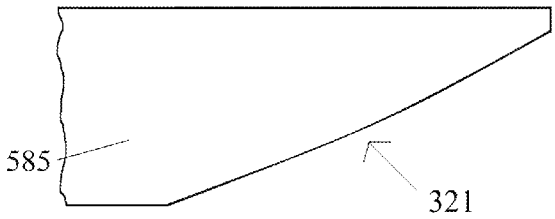
FIG. 13 is an enlarged broken side sectional view of the encircled area designated in FIGS. 11 and 18 detailing a prehensile quick-release tab according to an embodiment herein.

FIGS. 10 through 14 depict an elongated bonding strip 300 from various perspectives in accordance with one embodiment. FIG. 10 is a front perspective of a helically shaped elongated bonding strip 300, illustrating insertion tab 380, insertion tab surface 510, contact surface 585, and prehensile quick-release tab 321. FIG. 11 is a broken bottom perspective view of an elongated bonding strip 300 with the insertion tab 380 at the top, and prehensile quick release tab 321 at the bottom. FIG. 11A is an enlargement of the encircled area designated in FIG. 11; insertion tab 380 and its constituent elements: insertion tab surface 510 and contact surface 585. FIG. 12 provides a broken enlarged sectional side view of insertion tab 380 taken along the section lines designated 12-12 in FIGS. 10, 11 and 18. FIG. 13 is an enlarged sectional view of a prehensile quick-release tab 321 taken along section lines designated 13-13 in FIGS. 10 and 11 and further designated in the encircled area in FIGS. 10 and 11.

Figure 14:
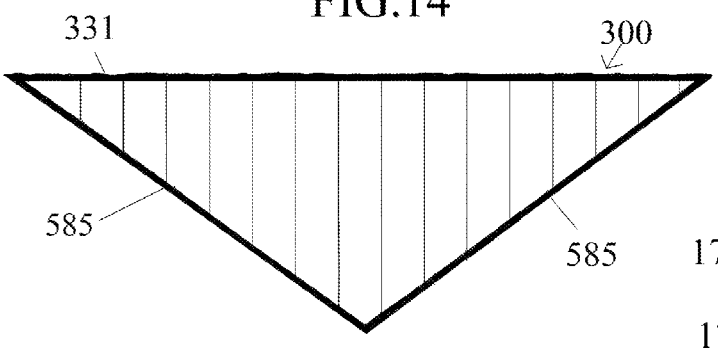
FIG. 14 is an enlarged sectional view of an elongated bonding strip taken along the section lines designated 14-14 in FIGS. 10 and 11 according to an embodiment herein.

FIG. 14 is an enlarged cross sectional view of an elongated bonding strip 300 taken along section lines designated 14-14 in FIGS. 10 and 11 displaying the top surface 331 and contact surface 585. Although the elongated bonding strip 300 in FIGS. 10, 11, 15 and 17 appear trihedral, the elongated bonding strip 300 and its embodiments may be oval, elliptical, trapezoidal, etc. or otherwise curved or non-linear, and the embodiments herein are not limited to any particular geometric configuration. For example, other possible alternate shapes of elongated bonding strips 300 are depicted as part of a congruous joint assembly 6 in FIGS. 17B and 19.

Figure 15:
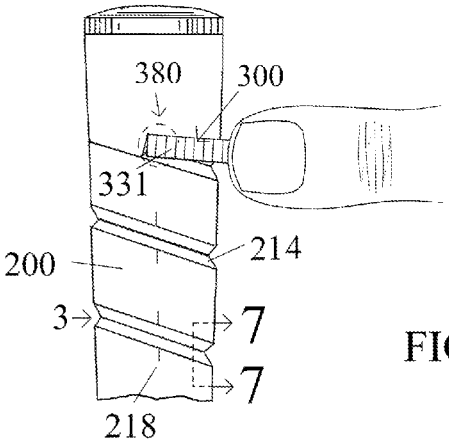
FIG. 15 is a broken front elevation view of an insertion tab of an elongated bonding strip being installed into the mouth of a continuous groove joint according to an embodiment herein.
Figure 15A:
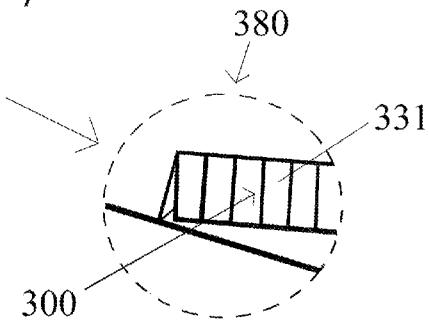
FIG. 15A is an enlarged detail view of the encircled area designated in FIG. 15 according to an embodiment herein.

FIG. 15 is a broken front elevation of the insertion tab 380 of elongated bonding strip 300 being mated with mouth 251 of the resilient coil assembly 8 embodying the embodiments herein. FIG. 15A is an enlarged detail view of the encircled area designated in FIG. 15. FIG. 16 is an elevation of an elongated bonding strip 300 in the process of being seated and fused with and into continuous groove joint 3 of a resilient coil assembly 8 (of FIG. 8). The seating of elongated bonding strip 300 into continuous groove joint 3 begins at mouth 251 as depicted is FIGS. 15 and 15A and continues along the entire length of continuous groove joint 3 leaving prehensile quick-release tab 321 and may protrude slightly beyond terminal end tab 212 (as shown in FIG. 1) creating an improved unitary golf club shaft grip 1 embodying the embodiments herein.

Figure 17:
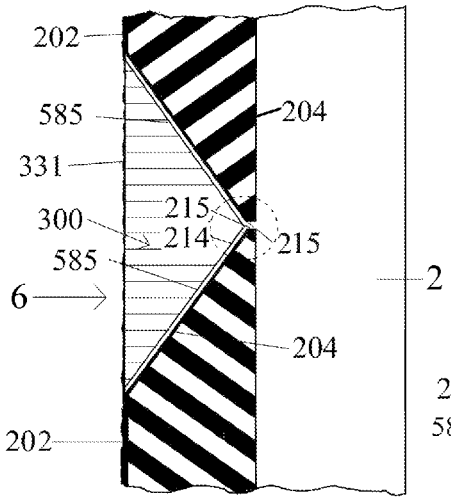
FIG. 17 is an enlarged sectional view taken along section lines designated 17-17 in FIGS. 1 and 16 detailing one possible shape of a congruous joint assembly according to an embodiment herein.

FIG. 17 is a cross sectional view of a congruous joint assembly 6 taken along the section lines designated 17-17 in FIGS. 1 and 16 embodying the embodiments herein. Contact surface 585 of elongated bonding strip 300 and groove wall 214 of continuous groove joint 3 have been fused forming congruous joint assembly 6. There are multiple possibilities with respect to the dimensional characteristics of the congruous joint assembly 6 including the shape, length, and number of contact surface 585 of the elongated bonding strip 300 and its embodiments, and the groove wall 214 and side edges 215 of continuous groove joint 3. However, groove wall 214 and contact surfaces 585 are generally congruent with its reciprocal counterpart of the continuous groove joint 3 throughout the helical length of resilient coil assembly 8. The cross section and other dimensional characteristics of the elongated bonding strip 300, its embodiments and their constituent elements: top surface 331 and contact surface 585 may vary at any point of its length to congruently reflect the dimensional characteristics of its reciprocal groove wall 214 counterpart along the length of continuous groove joint 3 of the resilient coil assembly 8.

Figure 17A:
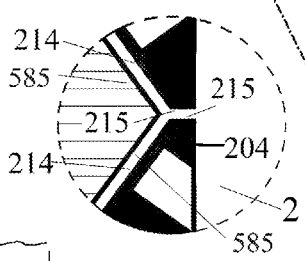
FIG. 17A is an enlarged detail view of the encircled area designated in FIG. 17 according to an embodiment herein.

FIG. 17A is an enlarged sectional detail view of the encircled area designated in FIG. 17 showing abutting side edges 215. The gap observed between side edges 215 and between contact surface 585 and groove wall 214 are for illustrative purposes only. In one embodiment, side edges 215, contact surface 585, and groove wall 214 are contiguous throughout and only separated by the thickness of adhesive in applications utilizing adhesives.

Figure 17B:
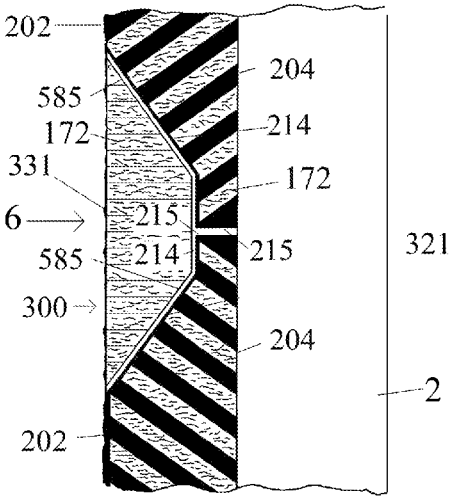
FIG. 17B is an enlarged sectional view of one possible shape of a congruous joint assembly taken along a random point of a golf club shaft grip comprised in whole or in part of self-fusing silicone according to an embodiment herein.

FIG. 17B displays a congruous joint assembly 6 and its component parts; namely elongated bonding strip 300 and resilient coil assembly 8, comprised in whole or in part of self-fusing silicone 172 in accordance with the embodiments herein. FIG. 17B displays a cross section of an example alternate configuration of a congruous joint assembly 6 and the relationship of its constituent components; namely elongated bonding strip 300 and contiguous groove joint 3 and their respective constituent elements; namely top surface 331, side edges 215, contacts surface 585, outside surface 202, inside surface 204, and groove wall 214.

Figure 18:
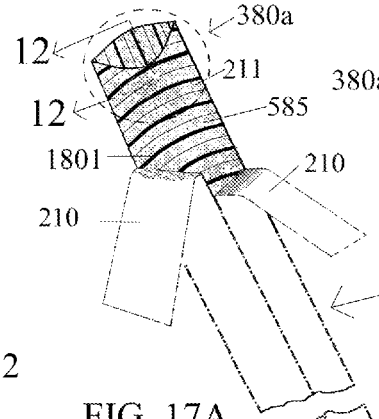
FIG. 18 is a bottom perspective view of a reinforced elongated bonding strip according to an embodiment herein.

FIG. 18 is a bottom perspective of a reinforced elongated bonding strip 300*a* in accordance with another embodiment herein. The reinforced elongated bonding strip 300*a* and its constituent elements; namely reinforced insert tab 380*a* and reinforced prehensile quick-release tab 321*a* have been impregnated with reinforcing mesh 1801 throughout its length in accordance with this embodiment. In this case, peel-away tape 36 (of FIG. 3) has been affixed to contact surface 585 and insertion tab surface 510 as a means of fusing contact surface 585 to groove wall 214 of contiguous groove joint 3. The reinforcing mesh 1801 can be seen under the adhesive 211 at the top of the figure where peel-away tape cover 210 has been removed from reinforced insertion tab 380*a*. Reinforcing mesh 1801 is added to reduce cracking and premature deterioration of elongated bonding strip 300*a*, the failure of congruous joint assembly 6, and the compromising of the durability and longevity of golf club shaft grip 1 in accordance with this embodiment herein. Moreover, the reinforcing mesh 1801 strengthens the entirety of reinforced bonding strip 300*a* including the reinforced prehensile quick-release tab 321*a* reducing incidents of breakage during separation of reinforced elongated bonding strip 300*a* from continuous groove joint 3 during removal. Reinforcing mesh 1801 may be made of a single or combination of natural and or composite materials including Kevlar® materials (available from Dupont, Del., USA) or any other suitable material which are added during the initial fabrication process.

Figure 18A:
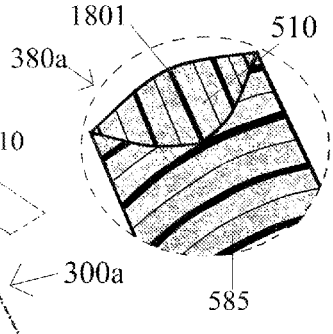
FIG. 18A is an enlarged bottom perspective view of the encircled area designated in FIG. 18 detailing a reinforced insertion tab according to an embodiment herein.
Figure 18A:
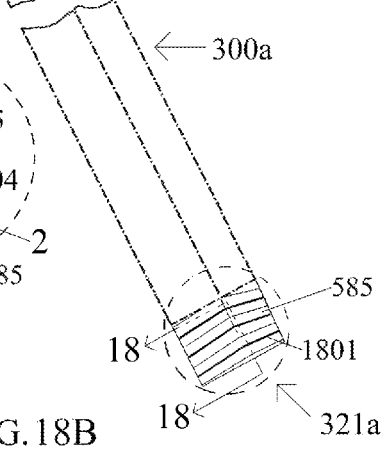
Figure 18B:
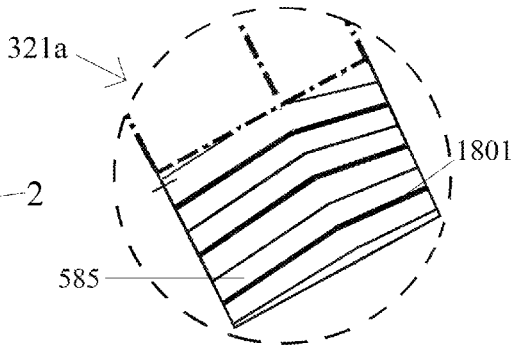
FIG. 18B is an enlarged bottom perspective view of the encircled area designated in FIG. 18 detailing a reinforced prehensile quick-release tab according to an embodiment herein.
Figure 19:
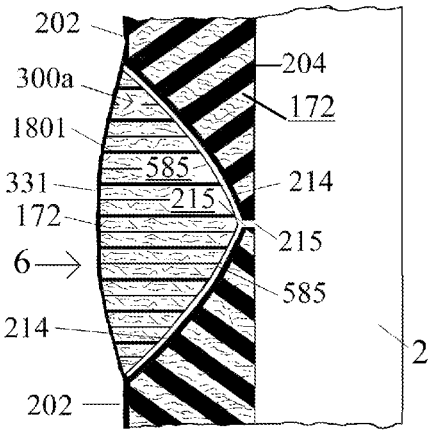
FIG. 19 is an enlarged sectional view of one possible shape of a congruous joint assembly taken along a random paint of a golf club shaft grip and its component parts according to an embodiment herein.

FIG. 18A is an enlarged view taken along the section lines designated 18-18 in the encircled area in FIG. 18 illustrating the reinforced insertion tab 380*a* with the impregnated reinforcing mesh 1801 in accordance with one embodiment. FIG. 18B is an enlarged view taken along the section lines designated 19-19 in the encircled area in FIG. 18 showing the reinforced prehensile quick-release tab 321*a*. FIG. 19 is a sectional view of an example alternate shaped congruous joint assembly 6 taken along a random point. The component parts of the congruous joint assembly 6 comprises, in whole or in part, of self-fusing silicone 172 and impregnated with reinforcing mesh 1801 in accordance with additional embodiments herein.

Figure 20:
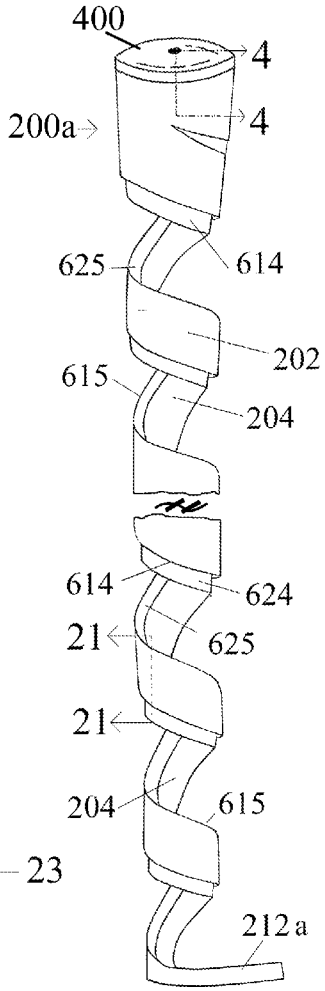
FIG. 20 is a front perspective view of a flanged helical resilient coil with an integral cap according to an embodiment herein.
Figure 22:
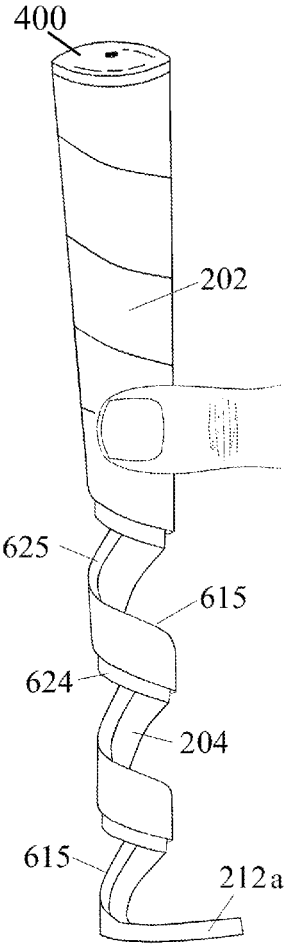
FIG. 22 is a front perspective view of a flanged helical resilient coil with an integral cap in the process of being spirally wrapped around a golf club shaft after the integral cap has been positioned over the open end of a golf club shaft according to an embodiment herein.
Figure 21:
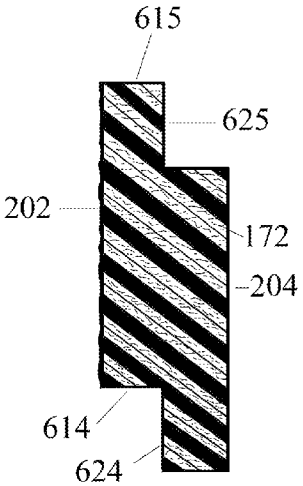
FIG. 21 is an enlarged sectional view of the section lines designated 21-21 in FIG. 20 according to an embodiment herein.
Figure 23:
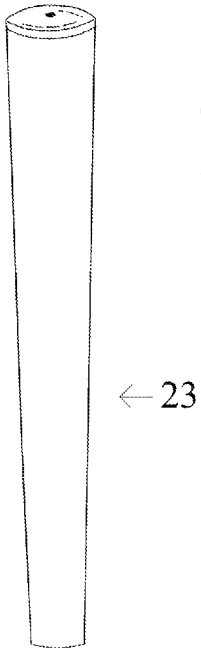
FIG. 23 is a front perspective view of a unitary elastic tubular sleeve type golf club grip according to an embodiment herein.

FIGS. 20 through 22 are several views of a flanged helical resilient coil 200*a* with integral cap 400 according to one embodiment herein displaying bottom edge 614, top edge 615, outside surface bottom edge 624, and inside surface top edge 625. FIG. 20 is a front broken elevation of a flanged helical resilient coil 200*a* with integral cap 400. FIG. 21 is a cross section taken along the section lines designated 21-21 in FIG. 20. FIG. 22 is a front elevation of flanged helical resilient coil 200*a* with integral cap 400 being wrapped around golf club shaft 2 after integral cap 400 has been successfully positioned over top of golf club shaft 2. In the interest of more clearly illustrating its constituent elements, the helical flanged resilient coil 200*a* is depicted as if suspended from integral cap 400 (of FIG. 4) influenced by gravity and slightly unwound.

The flanged helical resilient coil 200*a* with integral cap 400 can be manufactured, for example, through the process of injection molding, liquid injection molding, compression molding, transfer molding, or sectioning of a unitary elastic tubular sleeve 23 and is comprised, in whole or in part, of self-fusing silicone 172.

In accordance with the various embodiment herein, the golf club shaft grip 1 and its component parts; namely, helical resilient coil 200 with integral cap 400 and elongated bonding strip 300 and its embodiments may be comprised in whole or in part of self-fusing silicone 172. As two or more pieces of self-fusing silicon 172 fuse together when pressed, no supplemental adhesives are required to bond an elongated bonding strip 300 or its reinforced elongated bonding strip 300*a* with a resilient coil assembly 8 when forming a golf club shaft grip 1. Additionally, the strength and resilience of self-fusing silicone 172 greatly postpones the deterioration of a golf club shaft grip 1 due to weather, sunlight, or stresses resulting from use.

The operation/installation of helical resilient coil 200 with integral cap 400 comprises the following example process. The first step in installing the golf club shaft grip 1 is to prepare golf club shaft 2 by removing the old grip and thoroughly cleaning golf club shaft 2 using a suitable solvent cleaner. Next, in applications utilizing peel-away tape 36, the peel-away tape cover 210 located at terminal end tab 212 of helical resilient coil 200 with integral cap 400 is removed exposing the adhesive 211. The installer then manually positions integral cap 400 over the top of the golf club shaft 2 until the integral cap 400 is firmly seated onto the top of the golf club shaft 2. Additional twisting and maneuvering of the integral cap 400 may be required to correctly position integral cap 400 onto the open end of the golf club shaft 2. Then, while holding the integral cap 400 with one hand and outside surface 202 and inside surface 204 of the helical resilient coil 200 with integral cap 400 between the thumb and index of the other hand (thumb on outside surface 202), the installer wraps the helical resilient coil 200 with integral cap 400 around the golf club shaft 2, taking care that the side edges 215 abut, and the alignment mark 218 vertically aligns with the alignment mark 218 immediately above it until wrapping the terminal end tab 212 around itself forming resilient coil assembly 8 as depicted in FIG. 8. The exposed adhesive 211 attached to the inside surface 204 of terminal end tab 212 temporarily retards resilient coil assembly 8 from unraveling or loosening pending the fusion of elongated bonding strip 300 and resilient coil assembly 8 forming congruous joint assembly 6. In the embodiment where the helical resilient coil 200 with integral cap 400 is comprised, in whole or in part, of self-fusing silicone 172, the installation of helical resilient coil 200 with integral cap 400 is identical as described above.

As mentioned above, to insure proper wrapping of helical resilient coil 200 with integral cap 400 and construction of continuous groove joint 3, the installer takes care that side edges 215 abut snugly, and alignment mark 218 on the outside surface 202 vertically aligns with the alignment mark 218 on the outside surface 202 immediately above it by slightly and uniformly stretching the helical resilient coil 200 with integral cap 400.

Slight distention of helical resilient coil 200 with integral cap 400 during wrapping stores tensile energy. As the wrapped coil seeks to release its energy and return to its natural static state it compresses the fixed circumference of the golf club shaft 2 preventing slippage and helping affix resilient coil assembly 8 to golf club shaft 2. As nearly all tensile stress is directed against the longitudinal axis of the helical resilient coil 200 with integral cap 400, negligible forces influence the position of abutting side edges 215 leaving an extremely stable continuous groove joint 3. The frictional properties of elastomer material against the clean metallic surface of the golf club shaft 2 creates sufficient shear stress between resilient coil assembly 8 and the metal shaft 2 to temporarily resist unraveling. Opposing, but complementary, frictional forces between the two surfaces eliminate the need for the adhesives traditionally used to affix slip-on type golf grips to golf club shafts.

Without adhesives the installer is free to adjust the helical resilient coil 200 with integral cap 400 if unsuccessful or unsatisfied with the initial installation of the helical resilient coil 200 with integral cap 400 and construction of resilient coil assembly 8. Use of adhesives to affix the grip 1 to shaft 2 limit strip adjustments as readjustment undermine the integrity of the adhesive bond between shaft 2 and grip 1.

The helical resilient coil 200 with integral cap 400 can be manufactured through multiple processes including, for example, injection molding, liquid injection molding, compression molding, transfer molding, or sectioning a unitary elastic tubular sleeve 23, and may be comprised of variety of natural or composite of a single or plurality of natural or composite materials or in accordance with one embodiment comprised, in whole or in part, of self-fusing silicone 172.

With respect to the elongated bonding strip 300, in applications utilizing peel-away tape 36, the installer removes the peel-away tape cover 210 from elongated bonding strip 300. Then, while the installer holds the integral cap 400 in one hand, he/she places the thumb of the other hand on top surface 331 of insertion tab 380 and index finger under contact surface 585 of the elongated bonding strip 300. With the thumb on the top surface 331, the installer first places the insertion tab surface 510 against the mouth 251 of the resilient coil assembly 8, as depicted in FIG. 15, then continues to use the thumb to seat elongated bonding strip 300 into the continuous groove joint 3 of resilient coil assembly 8. Constant thumb pressure is applied to the top surface 331 of elongated bonding strip 300 to insure optimum contact between contact surface 585 of the elongated bonding strip 300 with groove wall 214 of the continuous groove joint 3 in order to activate pressure sensitive adhesive 211. 3M® adhesive transfer tape with 300LSE adhesive (available from 3M, Minnesota, USA) is an example of a peel-away adhesive that will provide sufficient bonding strength to fuse elongated bonding strip 300 with continuous groove joint 3 of resilient coil assembly 8 forming golf club shaft grip 1. To insure optimum fit between elongated bonding strip 300 and continuous groove joint 3, the elongated bonding strip 300 and continuous groove joint 3 are fabricated such that their dimensional characteristics, including length, width, shape, etc. of contacts walls, groove wall 214, etc. are congruent with its reciprocal counterpart throughout the helical length of the continuous groove joint 3.

Fusing the elongated bonding strip 300 and continuous groove joint 3 into congruous joint assembly 6 permanently prevents helical resilient coil 200 with integral cap 400 from unraveling, locks tensile forces within the golf club shaft grip 1, eliminates curling and fracturing of side edges 215, and eliminates the need for adhesives to secure golf club shaft grip 1 to golf club shaft 2.

The elongated bonding strip 300 may be comprised of a variety of natural materials or composites of a single or plurality of natural or composite material, and in accordance with one embodiment may be comprised, in whole or in part, of self-fusing silicone 172. Elongated bonding strip 300 may be manufactured through multiple processes, for example, including injection molding, liquid injection molding, compression molding, transfer molding, or sectioning a unitary elastic tubular sleeve 23.

To remove the golf club shaft grip 1 from the shaft 2, the golf player (or other individual) grasps the prehensile quick-release tab 321 located at the bottom of golf club grip 1 with a tool (e.g., pliers, etc.) or between the thumb and index finger and rips away the elongated bonding strip 300, separating elongated bonding strip 300 from continuous groove joint 3. If elongated bonding strip 300 fails to satisfactorily separate from resilient coil assembly 8, then the installer may use a knife or other sharp instrument to cut-away the remnants of golf club shaft grip 1 and remove from golf club shaft 2. With the golf club shaft grip 1 successfully dismantled and removed from golf club shaft 2, the installer is ready to begin the installation process.

In accordance with the embodiments herein the process of installing and removing the golf club shaft grip 1 its component parts; namely, helical resilient coil 200 with integral cap 400 and elongated bonding strip 300, the reinforced elongated bonding strip embodiment 300*a* and the alternate shapes are identical with the exception that if the component parts of a golf club shaft grip 1 are comprised, in whole or in part, of self-fusing silicone 172 in accordance with one embodiment, then peel-away tape 36 or other adhesives may not have to be utilized and therefore no removal of peel-away adhesive cover 210 or an addition of adhesive is required.

Installation of the flanged helical resilient coil 200*a* with integral cap 400 is similar to the construction of resilient coil assembly 8. The integral cap 400 is manually positioned over the open end of the golf club shaft 2. Then, while holding the integral cap 400 with one hand and outside surface 202 and inside surface 204 of the flanged helical resilient coil 200*a* with integral cap 400 between the thumb and index of the other hand, the installer slightly stretches the slowly winding the flanged helical resilient coil 200*a* with integral cap 400 around golf club shaft 2. The installer wraps the flanged helical resilient coil 200*a* with integral cap 400 so that the inside surface 204 of the top edge 615 lies flat on the outside surface 202 of bottom edge 614 and top edge 615 abut bottom edge 614 until reaching alternate terminal end tab 212*a*. The additional embodiment of the golf club grip 1 with a flanged helical resilient coil 200*a* and integral cap 400 has no elongated bonding strip 300.

In applications where the component parts of embodiments herein and its embodiments are comprised, in whole or in part, of self-fusing silicone 172, in accordance with one embodiment, installation and removal of embodiments herein are identical with the exception that peel-away tape 36 may not have to be attached and therefore removal of peel-away adhesive cover 210 may not be required. However, if the embodiments herein are comprised, in whole or in part, of self-fusing silicone 172, it does not preclude the use of peel-away 36 or other adhesives in installation and construction of the golf club shaft grip 1.

Accordingly, the embodiments herein provide an improved golf club grip 1 that can be quickly installed and removed without the commitment of time, inconvenience, and mess associated with installing and removing conventional one-piece tubular sleeve slip-on type golf club grips. The embodiments herein provide a golf club grip 1 that can be installed and removed by a person unskilled or inexperienced in the art of installing golf club grips. Furthermore, the embodiments herein provide a golf club grip 1 that does not require adhesives to secure the golf club grip 1 to the golf club shaft 2 dispensing with the difficulty of applying adhesives during installation and the mess associated with removing the adhesive residue upon removal. Moreover, the embodiments herein provide an improved golf club grip 1 that can be used immediately upon installation without waiting for the adhesives used in traditional applications to cure.

Also, the embodiments herein provide a golf club grip 1 that can be easily adjusted during installation to insure optimum fit. Conventional golf club grips generally depend upon adhesives to secure proper gripping to the golf club shaft or underlayment making it difficult, if not impossible, to adjust the grip once the wrapping process has begun without weakening the essential adhesive from repeated re-positioning of the wrapping. Moreover, it is difficult for a person unskilled in the art to properly align the flat strips typically used in conventional wrap-around style grips applications and therefore more likely to experience the attendant problems of re-wrappings including the expense of possibly having to replace the grip several times to in order to achieve a single satisfactory installation.

Additionally, the embodiments herein provide a wrap-around style golf club grip 1 where the abutting edges of the wrap do not fray or curl from repeated use or exposure to weather. The dimensional properties and material characteristics of the elongated bonding strip 300 preclude fraying or curling while the edges of the continuous groove joint 3 positioned beneath the elongated bonding strip 300 are unexposed. While conventional solutions typically rely on adhesives, the embodiments herein utilize the tensile stress of the interlocking edges to reduce occurrences of curling or fraying. The embodiments herein further provide a wrap-around style golf club grip 1 comprised, in whole or in part, of self-fusing silicone 172 eliminating the need for traditional adhesives.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A golf club shaft grip comprising:

a coiled strip component adapted to be spirally wrapped under tension around a golf club shaft;

a continuous groove joint formed along a spiral path adjacent said coiled strip component;

an elongated bonding strip permanently seated into said continuous groove joint; and a prehensile tab operatively connected at an end of said elongated bonding strip.

2. The golf shaft grip of claim 1, further comprising:

a cap positioned at a top portion of said coiled strip component; and a terminal end tab positioned at a bottom end of said coiled strip component.

3. The golf shaft grip of claim 2, wherein said cap comprises an integral structure with said coiled strip component.

4. The golf shaft grip of claim 2, wherein any of said coiled strip component, said cap, and said elongated bonding strip comprises elastic material.

5. The golf shaft grip of claim 4, wherein said elastic material comprises self-fusing silicone.

6. The golf shaft grip of claim 2, wherein said coiled strip component is adapted to be secured to said golf club shaft using any of peel-away adhesive and self-fusing silicone.

7. The golf shaft grip of claim 1, wherein said coiled strip component comprises an outer surface and an inner surface, wherein said groove joint comprises groove walls adjacent to each of a top and bottom of said outer surface, wherein said groove walls are formed along said spiral path adjacent said outer surface, and wherein said groove joint comprises a groove edge adjacent to each of said groove walls and said inner surface.

8. The golf shaft grip of claim 7, wherein said elongated bonding strip comprises contact surfaces, and wherein said elongated bonding strip is seated into said continuous groove joint causing a permanent bond between said groove walls and said contact surfaces.

9. The golf shaft grip of claim 8, further comprising peel-away adhesive in between said groove walls and said contact surfaces.

10. The golf shaft grip of claim 7, wherein said outer surface comprises a plurality of alignment marks adapted to be aligned with one another.

11. The golf shaft grip of claim 1, wherein said elongated bonding strip comprises a reinforcing mesh material configured therein.

* * * * *